US009163454B1

(12) United States Patent
Hopson

(10) Patent No.: US 9,163,454 B1
(45) Date of Patent: Oct. 20, 2015

(54) CORROSION RESISTANT SCREEN FRAME ASSEMBLY

(71) Applicant: Eric Hopson, North Fort Myers, FL (US)

(72) Inventor: Eric Hopson, North Fort Myers, FL (US)

( * ) Notice: Subject to any disclaimer, the term of this patent is extended or adjusted under 35 U.S.C. 154(b) by 0 days.

(21) Appl. No.: 13/956,719

(22) Filed: Aug. 1, 2013

(51) Int. Cl.
*E04C 3/06* (2006.01)
*E06B 9/52* (2006.01)

(52) U.S. Cl.
CPC ..... *E06B 9/52* (2013.01)

(58) Field of Classification Search
CPC ..... E06B 9/52
USPC ..... 160/371, 392, 395; 52/63, 222, 656.7, 52/177, 716.2; 49/501, 504
See application file for complete search history.

(56) References Cited

U.S. PATENT DOCUMENTS

| | | | | |
|---|---|---|---|---|
| 2,936,015 | A | 5/1960 | Rapata | |
| 3,362,276 | A | 1/1968 | Gould | |
| 4,731,960 | A * | 3/1988 | Sease | 52/36.6 |
| 4,899,797 | A | 2/1990 | Green | |
| 4,975,008 | A | 12/1990 | Wagner | |
| 5,249,403 | A | 10/1993 | Neilly et al. | |
| 5,293,723 | A * | 3/1994 | Slessor | 52/213 |
| 5,758,456 | A * | 6/1998 | Case | 52/177 |
| 5,857,298 | A * | 1/1999 | Fullwood | 52/202 |
| 5,910,084 | A | 6/1999 | Koike et al. | |
| 6,006,489 | A | 12/1999 | Zadok | |
| 6,170,212 | B1 * | 1/2001 | Suchyna et al. | 52/480 |
| 6,171,041 | B1 | 1/2001 | Bazinski et al. | |
| 6,192,643 | B1 | 2/2001 | Zadok | |
| 6,225,566 | B1 | 5/2001 | Dienst | |
| 6,263,949 | B1 | 7/2001 | Guthrie, Jr. | |
| 6,324,796 | B1 * | 12/2001 | Heath | 52/177 |
| 6,430,888 | B1 | 8/2002 | Dombchik et al. | |
| 6,668,495 | B1 * | 12/2003 | Prince | 52/63 |
| 6,901,646 | B2 | 6/2005 | Yoon | |
| 6,945,305 | B1 | 9/2005 | Limauro | |

(Continued)

FOREIGN PATENT DOCUMENTS

EP 0562324 A1 9/1993

OTHER PUBLICATIONS

Elite Aluminum Corporation, Elite 2000 "Screen Wall System—Patio Infill Edition," dated Jan. 4, 2013, <http://elitealuminum.com/wp-content/uploads/2013/03/00-EAC-1024_03a-Elite-2000-Screen-Wall-IBC.pdf>.

*Primary Examiner* — Katherine Mitchell
*Assistant Examiner* — Scott Denion
(74) *Attorney, Agent, or Firm* — Benjamin M. Hanrahan; Hanrahan Law Firm, P.A.

(57) ABSTRACT

A screen enclosure frame element structured to resist fluid from contacting the anchor is presented. Particularly, the frame element comprises an anchor channel disposed within an interior portion of the frame element between a head surface and a support side; the anchor channel being dimensioned to receive an anchor there through and into an engaging relation with the base. Further, the frame element of at least one embodiment includes at least one anchor retention assembly which at least partially defines the anchor channel. The retention assembly comprises a support wall connected to or a part of an inner side of the head surface at one end, and disposable in a fluid restricting relation with the support base at the other end. Other embodiments include a cap with a curvilinear surface configuration and/or a plurality of support ledges with corrugates surfaces disposed in a fluid restricting relation with the base.

20 Claims, 5 Drawing Sheets

(56) References Cited

U.S. PATENT DOCUMENTS

| | | | | |
|---|---|---|---|---|
| 6,964,290 | B2 * | 11/2005 | Woodward et al. | 160/92 |
| 6,973,757 | B2 | 12/2005 | Marks | |
| 7,526,902 | B2 * | 5/2009 | Green et al. | 52/656.9 |
| D608,912 | S | 1/2010 | Betty | |
| 7,861,473 | B1 | 1/2011 | Green | |
| 7,905,058 | B2 * | 3/2011 | Massey et al. | 49/365 |
| 7,937,899 | B2 | 5/2011 | Earls | |
| 8,056,602 | B1 | 11/2011 | Green | |
| 8,292,357 | B2 | 10/2012 | Caliskan et al. | |
| 8,327,588 | B2 * | 12/2012 | Seeger | 52/3 |
| 8,522,479 | B2 * | 9/2013 | Massey et al. | 49/365 |
| 2008/0302490 | A1 * | 12/2008 | Wilson | 160/371 |
| 2008/0307716 | A1 * | 12/2008 | Fisher et al. | 52/63 |
| 2010/0115852 | A1 * | 5/2010 | Daniels et al. | 49/504 |
| 2011/0076111 | A1 | 3/2011 | Suefuji et al. | |
| 2011/0094164 | A1 * | 4/2011 | Seeger | 52/2.14 |
| 2011/0197539 | A1 * | 8/2011 | Marocco | 52/656.7 |
| 2012/0110938 | A1 | 5/2012 | DesJardins, Jr. | |

* cited by examiner

CORROSION RESISTANT SCREEN FRAME ASSEMBLY

FIELD OF THE INVENTION

The present invention is generally directed to a screen frame assembly comprising a structurally supportive anchor retention assembly and structured to limit, minimize or eliminate water or other fluid from contacting the anchor(s), thereby limiting, minimizing or eliminating rust or corrosion thereof.

BACKGROUND OF THE INVENTION

Screened enclosures, typically for but not limited to homes and residences with balconies, patios, and/or pools, are extremely popular as the screened enclosure helps seclude the enclosed area from certain outer elements such as bugs and foliage while maintaining an outdoor atmosphere. In general, screened enclosures are commonly installed by securing a frame element to a base (such as a wood or concrete floor, slab, column, beam, ceiling, etc.) and then securing the screen material or panel to the frame element. A typical frame element is constructed of extruded metal or aluminum and then anchored to the base via a plurality of spaced apart anchors or screws.

A common drawback to the frame assembly for screened enclosures is that over time the anchor is exposed to the outer elements and water or other fluid (e.g., rain or pool water) causing the anchors to rust and corrode rather quickly. Corroded or rusted anchors may cause the frame assembly to fail, become disengaged with the base, and must therefore be replaced on a regular basis.

Particularly, when the anchor is driven through the frame element and into the base, oftentimes, the pressure causes the frame element to slightly buckle or cave inward creating a concave or indented configuration proximate the top portion or head of the anchor. The indented, concave or buckled area will then accumulate water or other fluid. The water or fluid accumulated at or near the head of the anchor causes the anchor to experience rapid deterioration, corrosion and rust.

Furthermore, water and other fluid can oftentimes seep under the outer edges of the frame element and into the interior portion of the frame element where the anchor meets the base. Water or other accumulation therein also cause the anchor to experience rapid deterioration, corrosion and rust.

There is thus a need in the art for a frame element that is structured to protect the anchor from unwanted accumulation of water or other fluid that can cause the anchor to corrode or rust. Therefore, the proposed invention comprises various structures and features that resist fluid from contacting the anchor or accumulating on the top surface of the anchor. The resistance to or protection from fluid causes the anchor to remain structurally intact for longer periods of time, prolonging the structural integrity of the frame element and screen frame assembly.

SUMMARY OF THE INVENTION

The present invention is generally directed to a frame element as part of a screen frame assembly for securing or attaching a screen to a building or other structure, for example, to create a screened enclosure, patio, pool deck, etc. Specifically, the frame element of certain embodiments of the present invention include a top or head surface and an oppositely disposed support side that is connectable or secured to a support base. The support base may include, but is not limited to a support column, beam, ground, ceiling, etc. or any portion of a building structure, for example. In particular, the frame element includes an anchor retention assembly which is disposed within an interior portion of the frame element and structured to at least partially define an anchor retention channel dimensioned to receive an anchor, such as a screw, bolt, etc., therein and into an engaging relation with the support base. As will be apparent from the discussion herein, the anchor retention assembly of at least one embodiment of the present invention comprises at least one support wall which is disposed in an at least partially encasing or fluid restricting relation to the anchor disposed within the anchor channel. Particularly, the support wall is disposable in an at least partially contacting and fluid restricting relation with the support base, and is therefore structured to restrict fluid (such as, but not limited to, rain or pool water) from flowing or seeping into the anchor channel, for example, between the bottom or second end of the support wall and the support base.

Furthermore, the anchor retention assembly of at least one embodiment is structured to support the head surface of the frame element and restrict or limit buckling of the surface, for example, during and after an anchor is driven through the frame element and into the base. Particularly, the support wall is structured to engage the base and support the oppositely disposed head surface as the anchor is driven there through. This limits or prevents buckling proximate the anchor channel and thereby minimizes or eliminates unwanted pooling or accumulation of water or other fluid thereon which can cause corrosion or rusting of the anchor.

As a further protection against fluid contacting the anchor, at least one embodiment of the present invention also includes a cap disposed in an overlying and/or covering relation to the head surface and/or the anchor channel of the frame element. Particularly, the cap may include a curved or curvilinear surface configuration structured to direct any water or fluid off of the cap and away from the anchor and anchor channel.

It should also be noted that the screen retention assembly of at least one embodiment of the present invention, which is structured to secure the screen material to the frame element, may be disposed externally to the cap, meaning that the maintenance, replacement, removal, and attachment of the screen material to the frame element may be accomplished without having to remove the cap from the frame element.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
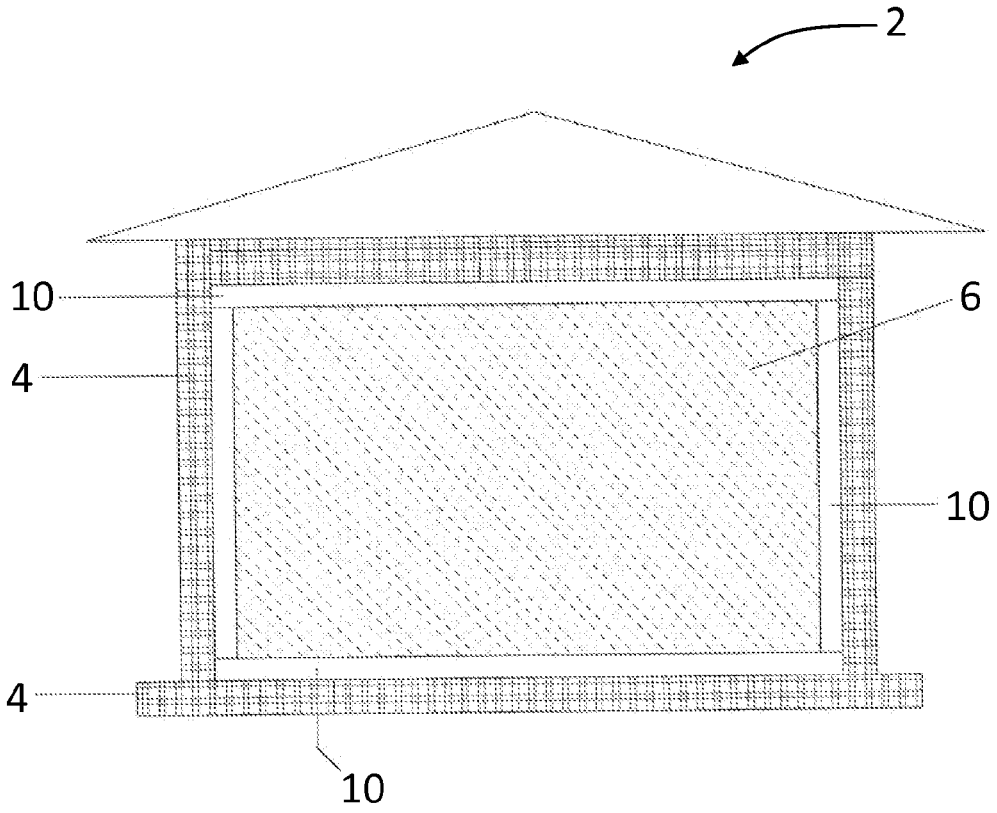
FIG. 1 is a schematic representation of a screen assembly attached to a structured, as described herein.

The present invention is directed to a screen frame assembly, and in particular a frame element 10 thereof. Specifically, as schematically illustrated in FIG. 1, a building, house or other structure, represented as reference character 2, may include a screen enclosure, for example, on a patio, pool area, balcony, etc. Generally, the screen enclosure includes a plurality of frame elements 10 which are attached or secured to a supporting base 4, such as, but certainly not limited to a floor, column, support beam, cross beam, ceiling, etc. constructed of a generally rigid and supportive material such as, for example, wood, concrete, etc. A screen element 6 or panel is then secured or attached to the various frame element(s) 10 in any manner including, for example, but not limited to, disposing a portion of the screen 6 into a screen retention channel or groove and securing the screen material or panel 6 therein via a flexible cord or spline, as will be described in more detailed herein.

Figure 2:
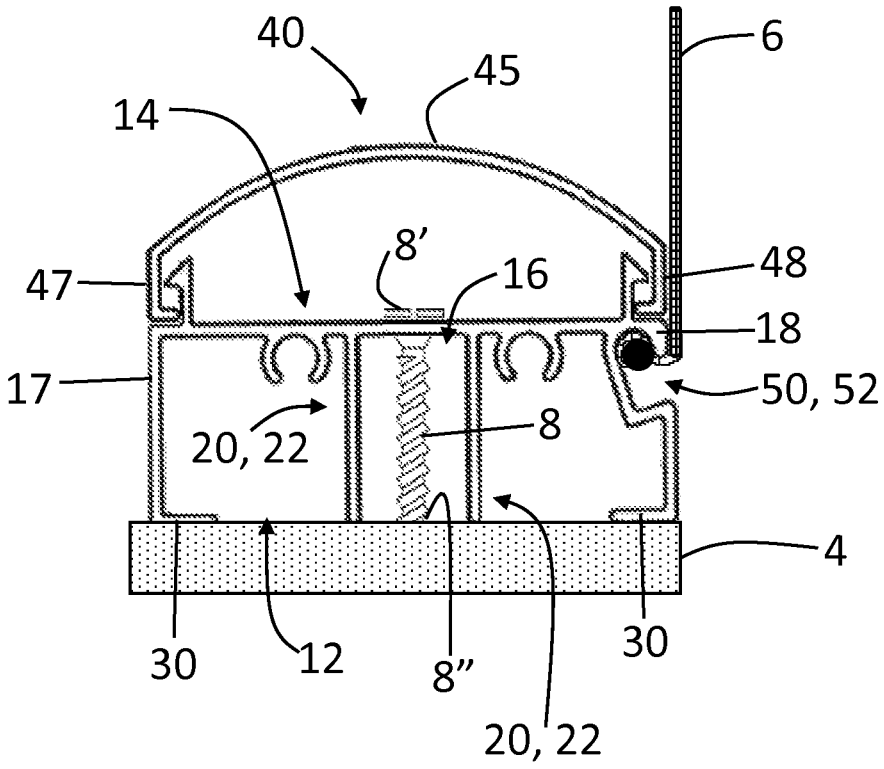
FIG. 2 is a side cut-away view of the frame assembly disclosed in accordance with at least one embodiment herein.

Referring now to the cross sectional view of FIG. 2, the various embodiments of the present invention disclosed herein comprise a frame element 10 which may be constructed of a generally rigid and/or sturdy material and can be, but is not necessarily, manufactured via extrusion techniques. Accordingly, the frame element(s) 10 of the present invention may comprise an extruded metal (or other material) frame comprising a generally elongated configuration which can be secured to a support base 4 and which can also receive the screen element or panel 6 therein so as to construct or assemble the screen frame assembly.

Accordingly, the frame element 10 comprises a support side 12 which is generally a bottom end of the element 10 secured or otherwise connected to the support base 4, as will be described in further detail herein. The frame element 10 of at least one embodiment further includes a head surface, generally represented as 14, which may be oppositely disposed relative to the support side 12. Particularly, the head side 12 of the frame element will generally receive an anchor 8 there through, wherein the head or upper end of the anchor 8 may engage the head surface 14 of the frame element 10, so as to secure the frame element to the base 4. It should be noted that the anchor 8 of the various embodiments of the present invention may include virtually any securing device including, but certainly not limited to, a screw, bolt, rivet, etc. Oftentimes, the material of the support base 4 at least partially dictates the type and size of the anchor 8 used to secure the frame element 10 to the support base 4.

Figure 3:
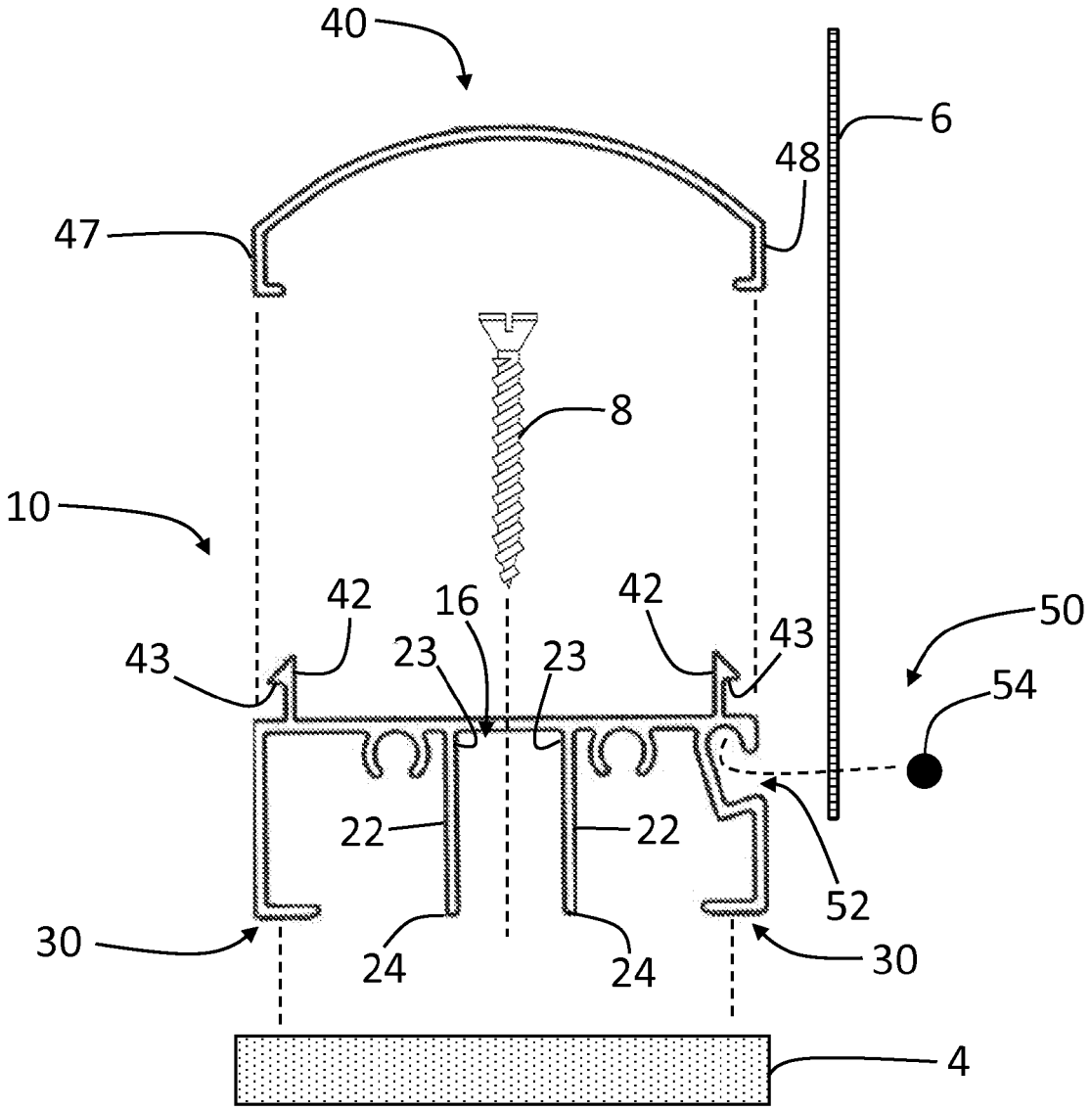
FIG. 3 is a side exploded view of the frame assembly illustrated in the exemplary embodiment of FIG. 2.

Furthermore, as shown in FIGS. 2 and 3, the frame element 10 of the present invention further comprises an anchor channel 16 disposed on an interior portion of the frame element 10 and between the head surface 14 and the support side 12. Particularly, the anchor channel 16 is sized and dimensioned to receive the anchor 8 therein such that the anchor 8 can engage the support base 4 (via a bottom or distal end 8') and concurrently engage the head surface 14 (via a top or proximate end 8"). As just one example, the width W1 of the anchor channel 16 of at least one embodiment may be one half (½) inches, although any other sizes may be contemplated so as to accommodate various sized anchors 8 and/or different sized or dimensioned frame elements 10. Furthermore, although only one anchor 8 is illustrated in the cut away view of FIGS. 2 and 3, the elongated frame element 10 of the present invention includes a plurality of spaced apart anchors 8 disposed along a length thereof in order to secure the entire frame element 10 to the base 4.

Particularly, the frame element 10 of the various embodiments of the present invention comprises an anchor retention assembly 20 which is structured to at least partially define the anchor channel 16. For instance, the anchor retention assembly 20 of at least one embodiment comprises at least one support wall 22 extending from an inner side of the head surface 14 to the support base 4. Specifically, the support wall 22 of at least one embodiment comprises a first or upper end 23 connected to, or extending from, an inner side of the head surface 14, as illustrated in FIGS. 2 and 3, for example. Further, the support wall 22 of at least one embodiment includes a second or bottom end 24 which is structured to engage or simply contact an outer surface of the support base 4. For exemplary purposes only, when the anchor 8 is disposed within the anchor channel 16, the side wall 22 or anchor retention assembly 20 is structured and disposed to engage the support base 4 (via second end 24). This engagement between with second end 24 and the base 4 may be due to compressive force exerted on the anchor 8 as the anchor 8 is driven into the base 4. In this manner, the anchor retention assembly 20 and/or second end 24 of the support wall 22 thereof may be disposed a in a fluid restricting engagement with the support base 4 so as to restrict fluid flow there between.

Accordingly, with the anchor 8 secured to the base 4 within the anchor channel 16, the anchor retention assembly 20 is structured to at least partially protect or seclude the anchor 8 within the channel 16. For example, should water (such as rain water, pool water, etc.) seep under the frame element 10, the fluid restricting engagement or contact between the anchor retention assembly 20 and the base 4 provides a seal or barrier between the anchor 8 and any water or fluid that may have inadvertently accrued or seeped under the frame element 10. This restriction of fluid from flowing into or contacting the anchor 8 provides protection or resistance to premature or undue corrosion or rust of the anchor 8.

Additionally, the anchor retention assembly 20 is further structured to restrict bending, warping, buckling, damaging or distorting of the head surface 14 proximate the anchor 8. For instance, without the anchor retention assembly 20 of at least one embodiment of the present invention, when the anchor 8 is driven down through the frame element 10 and into the base 4, oftentimes the top surface of the frame can be damaged or warped due to the pressure of the anchor 8. For example, the surface immediately surrounding the anchor 8 may form a concave or indented configuration due to the force of the anchor 8 being driven down through the frame and into the base. Water or fluid that can be damaging to the anchor 8 may then accumulate in the indented or concave warp and, over time, cause the anchor 8 to rust or corrode.

Accordingly, the anchor retention assembly 20 of the present invention is further structured to restrict or prevent the head surface 14 of the frame element 10 from forming a concave configuration or indentation proximate the anchor 8. In this regard, the structural integrity of the anchor retention assembly 20 and the engagement of the anchor retention assembly 20 between the base 4 and the head surface 14 is structured to provide support to the head surface 14 and thereby restrict or prevent inadvertent or unwanted warping or damage thereto when the anchor 8 is driven through the frame element 10 and into the base 4. Particularly, and for exemplary purposes only, in one embodiment, the head surface 14 comprises a generally flat configuration at or near the anchor 8. In that case, the anchor retention assembly 20 is structured to maintain the flat configuration of the head surface 14, even during and after the anchor 8 is driven there through and into engaging relation with the base 4. It should be noted, however, that the head surface 14 is not necessarily limited to comprising a flat configuration, and may instead include a sloped, convex, curvilinear, or other configuration.

Figure 5:
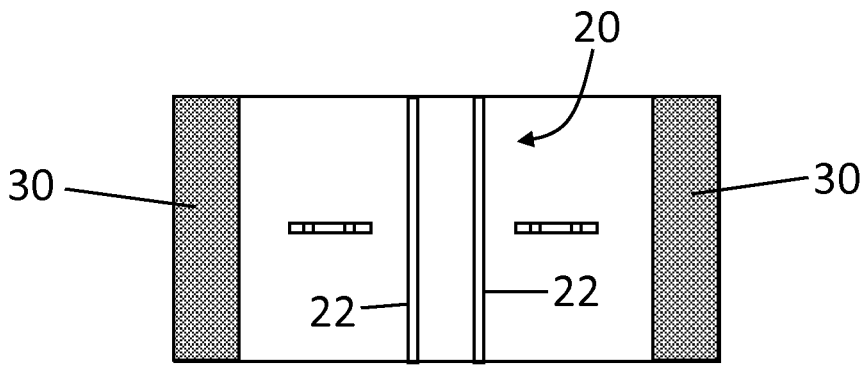
FIG. 5 is a bottom view of a frame element disclosed in accordance with at least one embodiment of the present invention.

As such, as illustrated in FIG. 5, in at least one embodiment, the anchor retention assembly 20 comprises at least two spaced apart support walls 22 which define the anchor channel 16 there between. In this regard, the support walls 22 may extend along the entire length (or a substantial portion) of the elongated frame element 10 wherein anchors 8 may be disposed therein in a selected spaced relation to one another. In this regard, the anchors disposed in the channel will be collectively at least partially enclosed or encased by the anchor retention assembly 20. It should also be noted that in certain embodiments, instead of continuous support walls 22 extending along the length or a substantial portion of the elongated frame element 10 (which creates one elongated anchor channel), a plurality of spaced apart support walls 22 may be disposed along the length of the frame element 20 to define a plurality of anchor channel 16.

Figure 6:
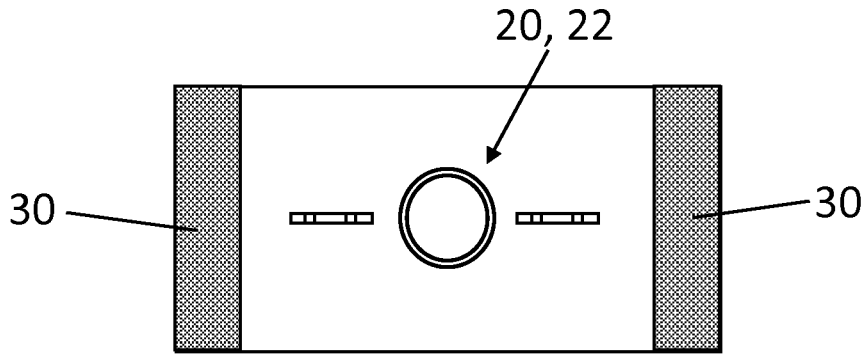
FIG. 6 is a bottom view of a frame element disclosed in accordance with another embodiment of the present invention.

Furthermore, referring now to FIG. 6, yet another embodiment of the anchor retention assembly 20 is illustrated. Particularly, in at least one embodiment, the anchor retention assembly 20 may comprise a support wall 22 of a generally circular or rounded configuration defining a plurality of anchor channels 16 along the length of the elongated frame element 10. Specifically, in the embodiment shown in FIG. 6, the support wall 22 is structured to individually surround and encase the anchor disposed therein. Of course, other configurations are contemplated, such as generally square, rectangular, triangular or other substantially surrounding configurations.

Referring to FIGS. 2-4 and 7, as yet another protection against fluid flowing to the anchors 8, at least one embodiment comprises one, but more practically, two oppositely disposed support ledges 30 disposable in a secure, supporting and fluid restricting relation with the base 4. Particularly, as shown, the support ledges 30 comprise a partially elongated foot, which in at least one embodiment, extends from oppositely disposed outer ends of the frame element 10 toward an interior portion of the frame element 10. As just one example, the width W2 of the foot or contacting surface of support ledges 30 may be in the range of about 0.25 inches, although other widths are certainly contemplated within the full spirit and scope of the present invention.

For instance, when the anchor 8 is disposed through the anchor channel 16 and into an engaging relation with the base 4, the support ledges 30 are structured to provide a substantial amount of surface area in contact with the base 4, via pressure and frictional force, which, in turn, helps restrict or prevent fluid, such as rain water or pool water, from flowing underneath the frame element 10, for example, between the support ledges 30 and the base 4. In addition to the anchor retention assembly 20 described herein, the support ledges 30 provide further restriction and prevention of fluid from contacting the anchors 8.

Figure 7:
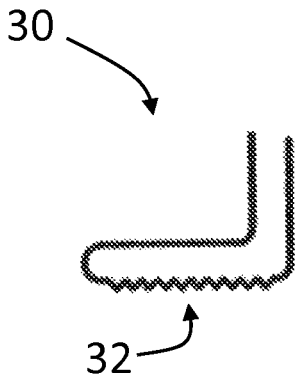
FIG. 7 is a partial cut away view of a support ledge disclosed in accordance with at least one embodiment of the present invention.

In at least one embodiment, the under surface or base contacting surface of the support ledges 30 comprise a corrugated, ribbed, or uneven configuration 32, as best illustrated in FIG. 7. For example, in one embodiment, the extruded material or metal may be formed to include tightly disposed ridges and valleys on the bottom or underside of at least one of the support ledges 30 to create further resistance to fluid flow. Particularly, the corrugated, ribbed, or uneven configuration 32 creates a plurality of barriers and contact points between the support ledges 30 and the base 4, further restricting fluid from flowing between the base 4 and the ledges 30. It should be noted that the uneven or corrugated surface 32 may, in at least one embodiment, be added as part of an additional rubber, plastic or metal piece attached to the bottom surface of the ledges 30, for example, via heat, adhesive, screws, nails, or other connectors.

In yet another embodiment of the present invention, the frame element 10 further comprises a cap 40 removably connected to the frame element 10, for example, via a cap attachment assembly. As just one example, the attachment assembly may comprise one or more clips 42 comprising a retention ledge 43 connectable to cooperatively structured and disposed retention brackets 44 or edges. In one embodiment the clips 42 are disposed on a surface or portion of the frame element 10 and the cooperatively structured bracket or edge 44 is disposed on the cap. Other embodiments may include other attachment assemblies or structures, to facilitate a secure attachment of the cap to the frame element 10.

As shown in FIG. 3, for example, the cap 40 is disposed in an overlying relation to the head surface 14, and in particular, to the anchor 8 and anchor channel 16. Particularly, the cap 40 of the various embodiments, is structured and disposed to provide protection to the anchor 8 from the outer elements, and specifically, from fluid, including, but not limited to rain and pool water. As such, the cap 40 creates an upper housing or shield disposed in an overlying relation to the anchor 8 restricting fluid from flowing onto the top portion of the frame element 10, and specifically, in one embodiment, the head surface 14 proximate the anchor 8 or anchor channel 16.

Figure 4:
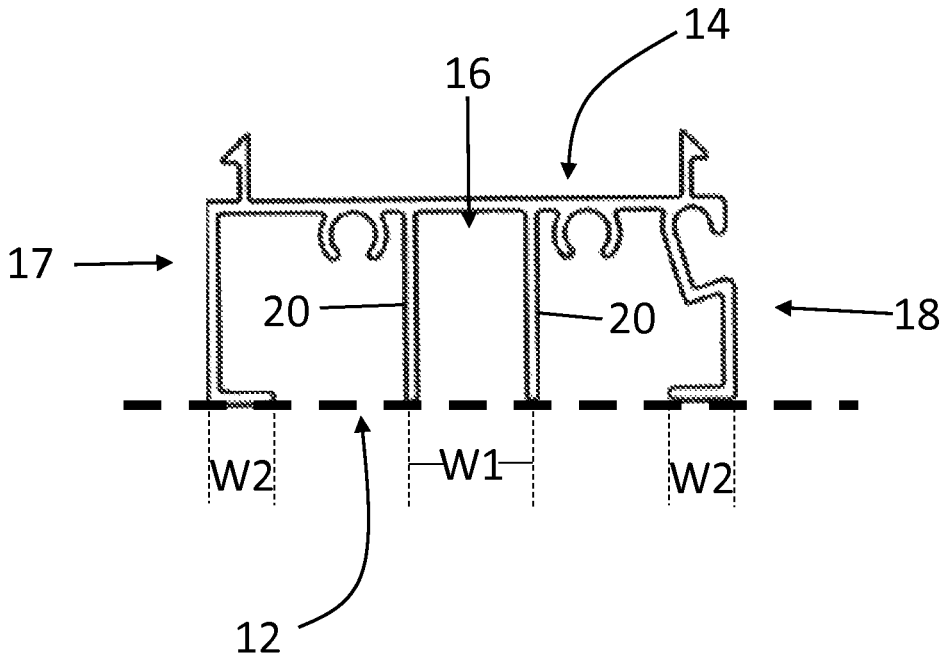
FIG. 4 is a side cut-away view of the frame element of the embodiment illustrated in FIGS. 2 and 3.

Further, as shown in FIGS. 2 and 3, the cap 40 of at least one embodiment, comprises a partially rounded or curvilinear surface configuration, represented as reference character 45. Particularly, in one embodiment, the curvilinear surface configuration 45 defines a convex configuration covering at least a portion of the head surface 14 and in particular the anchor 8 and anchor channel 16. The curvilinear surface configuration 45 is structured to facilitate a flow of fluid off of the surface 45 and down the edges thereof, away from the anchor 8 and/or anchor channel 16. Accordingly, in one embodiment, the edges 47, 48 may be disposed in a substantially aligned relation with edges or sides 17, 18 of the frame element 10, as illustrated in FIGS. 3 and 4. Further, it should be noted, that in at least one embodiment, the cap 40 is disposed along the entire, or a substantial portion of, the elongated frame element 10.

As mentioned above, the present invention further comprises a screen retention assembly 50, which is structured to removably receive the screen material 6 therein, or otherwise engage the screen material 6 so as to connect the screen material 6 to the frame element 10. Particularly, in one embodiment, the screen retention assembly 50 comprises a groove or channel 52 and a cooperatively sized and structured spline or elongated, generally flexible structure dimensioned to fit within the groove and secure the screen material 6 therein. Specifically, the spline screen material 6 may be disposed within the groove 52 and secured therein via insertion of the spline 54 on top of or in overlying relation to the screen material 6. A roller or other tool or utensil may be used to securely dispose the spline 54 and screen material 6 within the groove 50. Other screen retention assemblies 50 may be used and are contemplated within the full spirit and scope of the various embodiments of the present invention.

It should be noted, however, that in certain embodiments, the screen retention assembly 50 is disposed external to the cap 40 when the cap 40 is secured or attached to the frame element 10, as shown in FIG. 2, for example. Particularly, the screen retention assembly 50 may be disposed on a screen retention side 18 of the frame element 10, which is different than the head surface 14 or surface that the cap 40 overlies or protects. In such an embodiment, the screen material 6 may be inserted into and removed from the screen retention assembly 50 without having to adjust, remove or disconnect the cap 40 from is engagement with the frame element 10. This not only allows the cap 40 to maintain a secure, tight, and fluid restricting engagement with the frame assembly 10, but it also allows for easy access and maintenance to the screen material 6. As an example, if the screen material 6 rips, tears or otherwise needs to be replaces, the user may simply remove the screen material 6 from the screen retention assembly 50 and replace the screen material 6 without having to remove the cap 40 from the frame element 10. Removal of the cap 40 from the frame element exposes the cap 40 to potential damage, e.g., by accidentally or inadvertently breaking the attachment clips or assembly. It also maintains the cap 40 in the fluid restriction position relative to the anchor 8 and anchor channel 16 even while maintenance on the screen material 6 is performed.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. A screen frame assembly, comprising:

a frame element comprising a substantially planar head surface and an oppositely disposed at least partially open support side, the frame element configured to retain a screen, at least one anchor retention assembly at least partially defining an anchor channel disposed within an interior portion of said frame element between said head surface and said support side, said anchor channel being dimensioned to receive an anchor there through and into an engaging relation with a substantially planar support base, the support base being a separate structure upon which said frame element is mounted, and wherein said anchor retention assembly comprises at least one support wall extending in a perpendicular relation from an inner side of said head surface to said at least partially open support side, said at least one support wall comprising a first end and a second end, said first end of said support wall being connected to said inner side of said head surface and said second end of said support wall being disposable in a direct engaging relation with an outer surface of the support base.

2. The screen frame assembly as recited in claim 1 wherein said direct engaging relation between said second end of said support wall of said anchor retention assembly and the support base is structured to restrict fluid flowing through said at least partially open support end and into said anchor channel between said second end and the support base.

3. The screen frame assembly as recited in claim 2 wherein said support wall of said anchor retention assembly is disposed in an engaging relation relative to the support base and said head surface, and wherein said support wall is structured to restrict said head surface from forming a concave orientation proximate said anchor channel.

4. The screen frame assembly as recited in claim 2 wherein said support wall of said anchor retention assembly is disposed in an engaging relation relative to the support base and said head surface, and wherein said support wall is structured to maintain said head surface in a substantially flat orientation proximate said anchor channel.

5. The screen frame assembly as recited in claim 1 further comprising at least one support ledge disposed on an outer end of said at least partially open support side of said frame element, said support ledge being disposed in a secure supporting relation with the support base.

6. The screen frame assembly as recited in claim 5 further comprising at least two support ledges, each disposed on an opposite outer end of said at least partially open support side of said frame element.

7. The screen frame assembly as recited in claim 6 wherein said at least two support ledges comprise corrugated support surfaces.

8. The screen frame assembly as recited in claim 7 wherein said corrugated support surfaces are structured to restrict fluid flow into the interior portion of said frame element between said support surfaces and the support base.

9. The screen frame assembly as recited in claim 1 further comprising a cap disposed in an overlying relation relative to said head surface of said frame element, and wherein said cap is disposed in an overlying relation relative to a cap attachment assembly, said cap attachment assembly being connected to and extending outwardly from said head surface of said frame element.

10. The screen frame assembly as recited in claim 9 wherein said cap comprises a curvilinear outer surface.

11. The screen frame assembly as recited in claim 10 wherein said curvilinear outer surface comprises a convex configuration.

12. The screen frame assembly as recited in claim 9 wherein said cap comprises opposite outer edges each disposed in a substantially aligned relation with a corresponding outer side of said frame element.

13. The screen frame assembly as recited in claim 9 further comprising a screen retention assembly disposed on a screen retention side of said frame element; said screen retention assembly being structured to connect a screen material to said frame element.

14. The screen frame assembly as recited in claim 13 wherein screen retention assembly is disposed externally relative to said cap while said cap is disposed in a connected relation to said frame element.

15. The screen frame assembly as recited in claim 14 wherein the screen material is disposable into and out of said screen retention assembly while said cap is disposed in said connected relation to said frame element.

16. A screen frame assembly, comprising:

a frame element comprising a head surface and an oppositely disposed support side, said frame element configured to retain a screen and further comprising two side walls extending from said head surface, said frame element comprising at least one anchor retention assembly disposed within an interior portion of said frame element and structured to at least partially define an anchor channel, said anchor channel being dimensioned to receive an anchor therein and into an engaging relation with a support base, the support base being a separate structure upon which the frame element is mounted, said anchor retention assembly comprising at least one support wall comprising a first end and a second end, said first end being connected to an inner side of said head surface, and said second end being disposable in a direct engaging relation with an outer surface of the support base, wherein said support wall is disposed in a perpendicular relation to the support base, and wherein said support wall is structured to restrict fluid flow into said anchor channel between said second end and the support base, said support wall being further structured to restrict said head surface from forming a concave orientation proximate said anchor channel, a cap attachment assembly comprising at least two clips extending outwardly from said head surface of said frame element, a cap removably connected to said cap attachment assembly and disposed in a covering relation to said head surface of said frame element and in a covering relation to said cap attachment assembly, wherein said cap comprises oppositely disposed outer edges disposed in a substantially aligned relation with correspondingly oppositely disposed sides of said frame element when said cap is connected to said cap attachment assembly, and a screen retention assembly disposed externally to said cap, wherein screen material is disposable into and out of said screen retention assembly when said cap is disposed in said covering relation to said head surface and said anchor channel.

17. The screen frame assembly as recited in claim 16 further comprising at least two support ledges disposed on opposite sides of said frame elements and disposable in a tight supporting relation with the support base.

18. The screen frame assembly as recited in claim 16 wherein said at least two support ledges comprise corrugated surfaces structured to restrict fluid flow between said support ledges and the support base.

19. The screen frame assembly as recited in claim 16 wherein said support side of said frame element comprises a substantially open configuration, and wherein said support wall is disposed in a directly engaging relation with the support base when said frame element is mounted on the support base.

20. A screen frame assembly, comprising:

a frame element comprising a substantially planar head surface and an oppositely disposed at least partially open support side, the frame element configured to retain a screen, said frame element comprising at least one anchor retention assembly disposed within an interior portion of said frame element and structured to at least partially define an open-ended anchor channel, said anchor channel being dimensioned to receive an anchor therein and into an engaging relation with a support base, the support base being a separate structure upon which the frame element is mounted, said anchor retention assembly comprising at least two support walls each comprising a first end and a second end, said first end of said support walls extending directly from an inner side of said head surface, and said second end of said support walls being disposable in a direct engaging relation with the support base, said frame element further comprising at least two support ledges disposed on opposite sides thereof, each of said support ledges being disposed in a direct engaging relation with the support base, and wherein said at least two support walls and said at least two support ledges collectively provide at least four independent direct engaging contacts between said frame element and the support base.

* * * * *